US010711484B2

(12) United States Patent
Justus

(10) Patent No.: US 10,711,484 B2
(45) Date of Patent: Jul. 14, 2020

(54) AIR HANDLING UNIT AND METHOD OF ASSEMBLING THE SAME

(71) Applicant: Charles Robert Justus, Wildwood, MO (US)

(72) Inventor: Charles Robert Justus, Wildwood, MO (US)

( * ) Notice: Subject to any disclaimer, the term of this patent is extended or adjusted under 35 U.S.C. 154(b) by 0 days.

(21) Appl. No.: 16/238,285

(22) Filed: Jan. 2, 2019

(65) Prior Publication Data

US 2019/0203496 A1 Jul. 4, 2019

Related U.S. Application Data

(60) Provisional application No. 62/612,874, filed on Jan. 2, 2018.

(51) Int. Cl.

| | |
|---|---|
| ***E04H 15/12*** | (2006.01) |
| ***E04H 15/14*** | (2006.01) |
| ***F24F 13/02*** | (2006.01) |
| *E04H 15/32* | (2006.01) |

(52) U.S. Cl.

CPC ..... *E04H 15/14* (2013.01); *E04H 15/12* (2013.01); *F24F 13/02* (2013.01); *F24F 13/0236* (2013.01); *E04H 15/32* (2013.01)

(58) Field of Classification Search

CPC ..... E04H 15/12; E04H 15/14; E04H 15/22; F24D 5/02; F24D 5/04; F24D 7/00; F24D 12/00

USPC ..... 135/92, 93; 52/220.8; 454/237, 241, 454/243, 245–249; 237/53

See application file for complete search history.

(56) References Cited

U.S. PATENT DOCUMENTS

| | | | | |
|---|---|---|---|---|
| 2,052,315 A * | 8/1936 | Riesner | F24F 7/04 454/367 |
| 2,105,108 A * | 1/1938 | Crosley, Jr. | F24F 1/022 62/261 |
| 2,170,576 A * | 8/1939 | Shaver | F24F 6/025 261/92 |
| 2,297,150 A * | 9/1942 | Hunter | E04H 15/20 52/2.21 |
| 2,463,090 A * | 3/1949 | Dixon | A61G 10/04 62/261 |
| 2,581,709 A * | 1/1952 | Rogers | F24F 1/04 165/121 |
| 2,910,994 A * | 11/1959 | Joy | E04H 15/22 52/2.11 |

(Continued)

FOREIGN PATENT DOCUMENTS

| | | |
|---|---|---|
| CN | 201031520 Y | 3/2008 |
| CN | 203669481 U | 6/2014 |

(Continued)

*Primary Examiner* — Robert Canfield
(74) *Attorney, Agent, or Firm* — Armstrong Teasdale LLP

(57) ABSTRACT

An air handling unit for use with a heating, ventilating, and air conditioning (HVAC) system includes an air input portion configured to receive conditioned air. The air handling unit also includes an air output portion configured to direct the conditioned air to an interior space of a structure. The air handling unit further includes a routing portion configured to couple the air input portion to the air output portion in fluid communication. The routing portion also includes a contouring structure configured to interface with the structure.

20 Claims, 6 Drawing Sheets

(56) References Cited

U.S. PATENT DOCUMENTS 2,948,286 A * 8/1960 Turner ..... E04H 15/22 52/1
3,150,670 A * 9/1964 Bird ..... E04H 15/22 52/2.14
3,159,165 A * 12/1964 Cohen ..... E04H 15/22 52/1
3,389,510 A * 6/1968 Stock ..... E04H 15/22 52/2.17
3,766,844 A * 10/1973 Donnelly ..... F24F 3/1603 454/238
4,883,512 A * 11/1989 Griffis ..... B01D 46/00 55/356
5,331,991 A * 7/1994 Nilsson ..... A62B 13/00 135/93
5,725,426 A * 3/1998 Alvarez ..... A61G 13/108 135/90
6,148,630 A * 11/2000 Saccone ..... F24F 1/027 62/259.1
6,402,613 B1 * 6/2002 Teagle ..... F04D 19/002 454/195
6,508,850 B1 * 1/2003 Kotliar ..... A61G 10/005 55/385.2
6,941,677 B2 * 9/2005 Adrian ..... F24H 1/06 126/110 B
7,735,502 B1 * 6/2010 Hotes ..... E04H 15/36 135/136
7,997,004 B1 * 8/2011 Adrian ..... E04H 15/12 126/109
9,410,342 B2 8/2016 Napier et al.
9,829,896 B1 * 11/2017 Arend ..... F24F 1/02
2005/0103370 A1 * 5/2005 Napier ..... E04H 15/14 135/93
2005/0246942 A1 * 11/2005 Mueller ..... A01M 1/2094 43/124
2006/0000164 A1 * 1/2006 Raeburn ..... B32B 27/12 52/219
2006/0270335 A1 * 11/2006 Kim ..... F24F 3/147 454/237
2008/0022604 A1 * 1/2008 Newton ..... A63G 31/12 52/2.11
2008/0264461 A1 * 10/2008 Harris ..... E04H 15/12 135/120.1
2009/0320380 A1 * 12/2009 Chelf ..... F24F 7/007 52/2.11
2011/0092150 A1 * 4/2011 Morier ..... D06F 58/20 454/237
2013/0281000 A1 * 10/2013 Newcomer ..... F24F 7/08 454/237
2014/0352344 A1 * 12/2014 Guercio ..... F24F 13/222 62/291

FOREIGN PATENT DOCUMENTS

DE 4304852 A1 * 8/1994 ..... F24F 3/1603
DE 102015225779 A1 * 6/2017 ..... A61G 10/02
FR 1309320 A * 11/1962 ..... E04H 15/22
JP 2003139383 A * 5/2003 ..... F24F 1/0003

* cited by examiner

AIR HANDLING UNIT AND METHOD OF ASSEMBLING THE SAME

CROSS-REFERENCE TO RELATED APPLICATIONS

This application is a non-provisional application and claims priority to U.S. Provisional Patent Application Ser. No. 62/612,874, filed Jan. 2, 2018, which is hereby incorporated by reference in its entirety.

BACKGROUND OF THE INVENTION

The embodiments described herein relate generally to heating, ventilating, and air conditioning (HVAC) systems. More particularly, the present embodiments relate to various systems, components and methods for implementing HVAC upon temporary structures.

Existing methods for the heating, ventilating, and air conditioning (HVAC) of temporary structures have generally included ad-hoc temporary structure HVAC systems centered around commercial, off the shelf HVAC units. At least one known method to cool a temporary structure includes utilizing HVAC units that can be noisy or include generally aesthetically unpleasing or homemade components taking on an improvised or unprofessional appearance. For example, many temporary structure HVAC systems have utilized readily available building materials such as 2×4 lumber and plywood. Additionally, at least some known HVAC systems include ducting that extends beneath a malleable wall of the temporary structure to channel air into the structure. Such ducting may create undesirable gaps between two or more of the wall, the ducting, the floor of the temporary structure, and the ground. Furthermore, at least some known HVAC systems do not allow for adjustability and redirection of air flow.

BRIEF DESCRIPTION

In one aspect, an air handling unit for use with a heating, ventilating, and air conditioning (HVAC) system is disclosed. The air handling unit includes an air input portion configured to receive conditioned air. The air handling unit also includes an air output portion configured to direct the conditioned air to an interior space of a structure. The air handling unit further includes a routing portion configured to couple the air input portion to the air output portion in fluid communication. The routing portion also includes a contouring structure configured to interface with the structure.

In another aspect, a heating, ventilating, and air conditioning (HVAC) system is also disclosed. The HVAC system can be utilized in a temporary structure defining an interior space and an exterior environment. The HVAC system can include an HVAC unit positioned in the exterior environment and configured to channel conditioned air into an air handling unit. The air handling unit can include an air input portion positioned in the exterior environment, the air input portion including at least one air inlet in fluid communication with the HVAC unit. The HVAC system also includes an air output portion positioned in the interior space for redirecting conditioned air, and a housing connecting the air input portion to the air output portion, the routing portion including a contouring structure configured to interface with the tent.

In yet another aspect, a method of assembling an air handling unit for a tent heating, ventilating, and air conditioning (HVAC) system is disclosed. The method includes forming an air input portion for accepting conditioned air and forming at least one air input receptacle into the air input portion. A further step includes forming an air output portion for directing the conditioned air to the interior space of a tent and forming a routing portion connecting the air input portion and the air output portion. The method includes coupling the routing portion between the air input portion and the air output portion such that the air input portion and the air output portion are in fluid communication. An angled side surface is coupled between a top surface and a bottom surface located on the air input portion, wherein the angled side surface is obliquely oriented between the top surface and the bottom surface.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
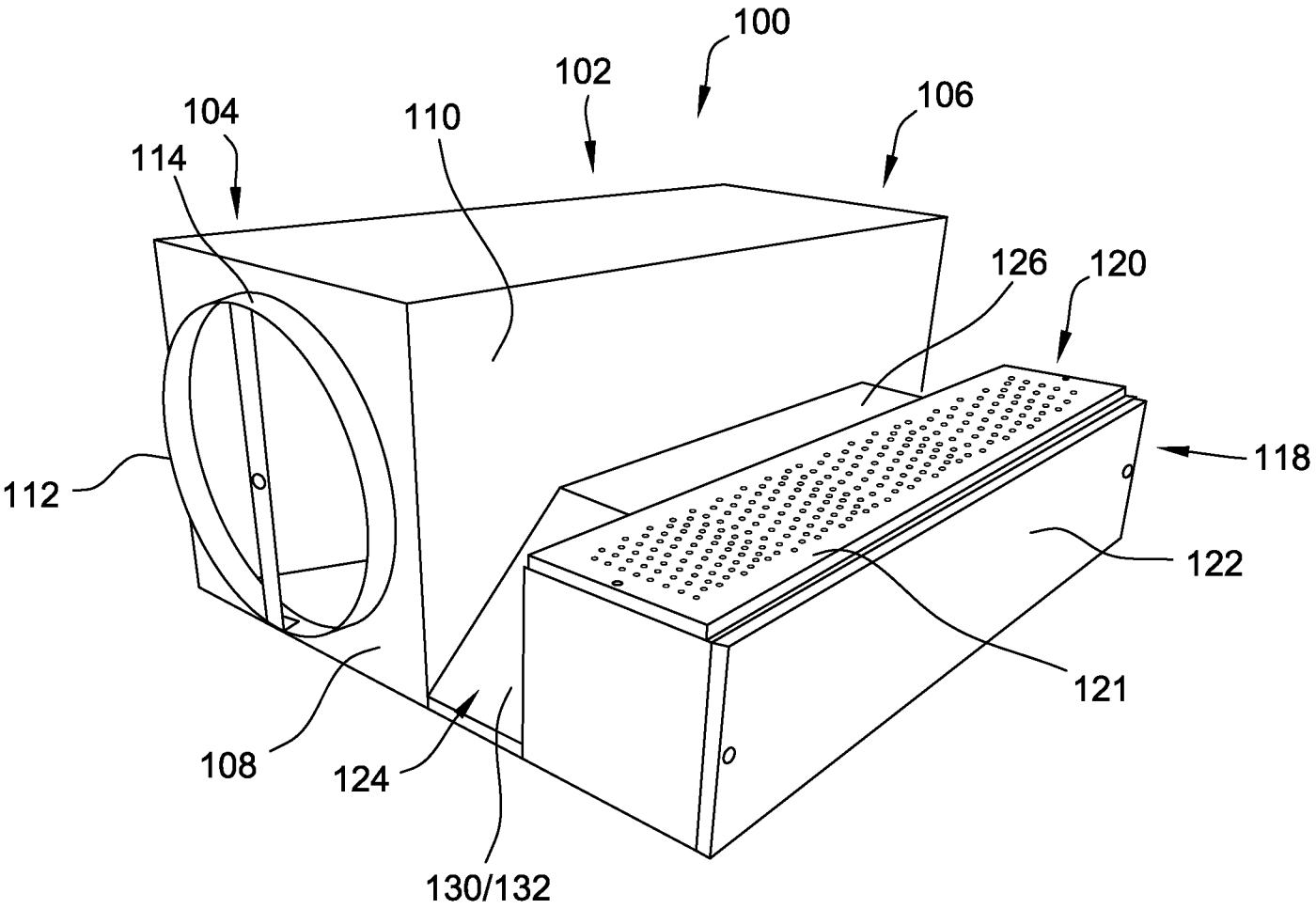
FIG. 1 depicts a front perspective view of an exemplary air handling unit suitable for use with a temporary structure HVAC system.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

One solution to the aforementioned issues is to utilize an air handling unit in a HVAC system for a temporary structure. In some embodiments, the air handling unit includes an air input portion for accepting conditioned air and an air output portion for outputting the conditioned air. The air input portion and the air output portion can be connected via a routing portion. For example, the routing portion is configured to couple the air input portion to the air output portion. The air input portion can include one or more air inlet portions for accepting conditioned air. The air inlet portions can each include a removable plate positionable over the air inlet portions for preventing airflow through the air inlet portions. The air inlet portions can also include flanges circumscribing the air inlet portions for facilitating the connection of an HVAC unit. Conditioned air can include heated air, cooled air, ventilated air, filtered air, humidified air, and de-humidified air. In other embodiments, the air output portion can include a structure for redirecting air such as a pivot mechanism or a cover plate. For example, the air handling unit can be a component of a temporary structure HVAC system. The air input portion can be located in the exterior of the temporary structure, the air output portion can be located interior of the temporary structure, and the routing portion can be located both in between the air input portion and air output portion as well as both the exterior and interior of the temporary structure.

In an exemplary embodiment, the routing portion can include a contouring structure for enhancing aesthetics and thermal efficiency. For example, in a temporary structure HVAC system, the temporary structure can take of the form of a tent, marquee, big top, dome tent, pup tent, teepee, wigwam, gazebo, pavilion, yurt, yaranga, palapa, or any structure not intended to be a permeant fixture. Further, the temporary structure can also include side walls at least partially detached from the ground. The temporary structure can separate an interior space from an exterior environment. The routing portion can reside between the side walls and the ground such as in between the side walls and apportion where the side walls are not attached to the ground. The air input portion can reside in the exterior environment and while the air output portion resides in the interior space. The side walls can fall around the contouring structure of the routing portion and naturally follow the contour of the routing portion by operation of gravity. For example, the contouring structure can include an angled surface such that the side walls naturally let the side wall fall to the ground. In other embodiments, the routing portion can include contouring structure to allow for the ground and side walls to naturally contour around the routing portion. In more embodiments, the interface between the contouring structure and the temporary structure can form an improved seal between the interior space and exterior environment of the tent thereby improving thermal efficiency.

These and other embodiments are discussed below with reference to FIGS. 1-6; however, those skilled in the art will readily appreciate that the detailed description given herein with respect to these figures is for explanatory purposes only and should not be construe as limiting.

FIGS. 1-4 depict front, rear, and side views of exemplary air handling unit 100 suitable for use with the temporary structure HVAC system. Air handling unit 100 can be used as a component in an HVAC system in order to redirect conditioned air into a temporary structure. An exemplary embodiment of air handling unit 100 measures approximately two feet in height H1 and depth D1 and five feet in width W1. However, any size necessary to be able to redirect air into the temporary structure can be utilized. Air handling unit 100 can be constructed out of aluminum including white aluminum, 6061 alloys, and 7075 alloys. Air handling unit 100 can also be constructed from other building materials such as steel. However, aluminum is preferable for weight rivets. Air handling unit 100 can also include a frame where sheet material is attached to the frame with fasteners. Sheet material can also be riveted to the frame with POP rivets.

Figure 2:
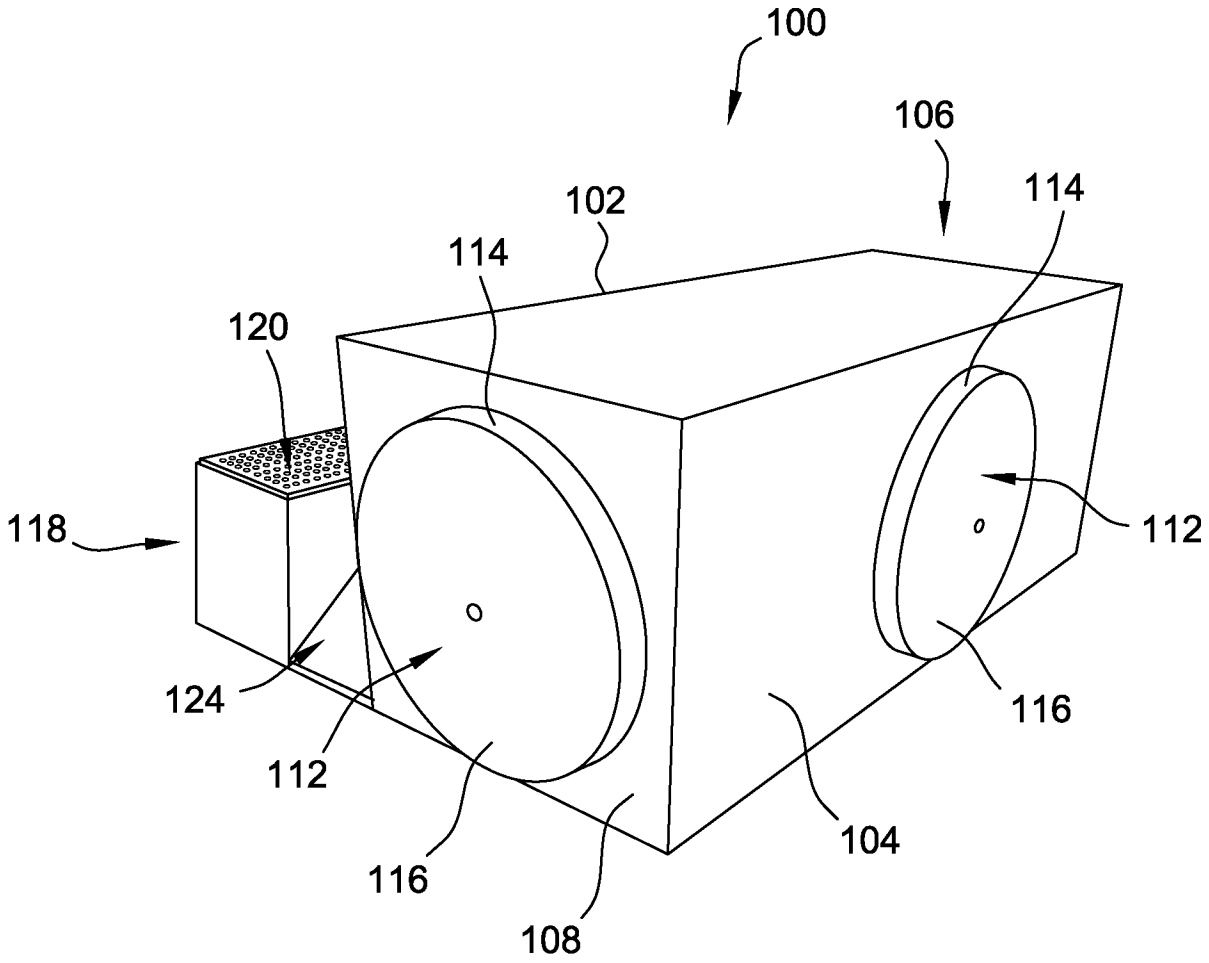
FIG. 2 depicts a rear perspective view of the air handling unit shown in FIG. 1.

Air handling unit 100 is generally a single structure or component of a larger HVAC system. However, air handling unit 100 can include several sections or portions. For example, air handling unit 100 includes an air input portion 102. Air input portion 102 takes the form of a rectangular prism. In some embodiments, air input portion 102 includes a first sidewall 104, a first endwall 106, and a second endwall 108. First sidewall 104 is oriented to generally face a rear of the air handling unit as in FIG. 3. First endwall 106 and second endwall 108 are oriented to face a side of air handling unit 100 as depicted in FIG. 2. First endwall 106 and second endwall 108 are oriented orthogonally to first sidewall 104. First endwall 106 is also oriented parallel to second endwall 108. A second sidewall 110 is oriented to face a front of air handling unit 100 and is parallel with first sidewall 104.

Walls 104, 106, and 108 each include one or more inlets 112. In an exemplary embodiment, inlets 112 are oriented generally in the center of each of walls 104, 106, and 108. However, walls 104, 106, and 108 can define any number of inlets of any number per wall. Walls 104, 106, and 108 can also define the inlets at any point on walls 104, 106, and 108. Further, each of walls 104, 106, and 108 include a collar or flange 114. Each flange 114 circumscribes a corresponding inlet 112 and extends from corresponding wall 104, 106, and 108 a distance to enable connecting a hose thereto. More specifically, in one embodiment, inlets 112 have a diameter Di of approximately 20 inches and flanges 114 protrude approximately two inches from each of walls 104, 106, and 108. Flanges 114 define inlets 112 that accept conditioned air such as conditioned air that originates from an HVAC unit. Additionally, air inlet portion 102 includes a plurality of covers 116 that are selectively coupled to flanges 114 to selectively block inlets 112. Covers 116 at least partially seal unused inlets 112 in the case where the HVAC unit utilizes only one or two inlets 112.

In the exemplary embodiment, air handling unit 100 also includes an output portion 118. Output portion 118 is configured to redirect air flow such as conditioned air to the interior space of a temporary structure. Output portion 118 takes the form of a rectangular prism shape and includes a height H2 and depth D1 of about one foot and a width of about five feet. In one embodiment, output portion 118 includes a grill panel 121 defining an air outlet 120 and also a solid cover panel 122. Grill panel 121 and cover panel 122 are coupled to output portion 118 and positioned over openings (not shown) in output portion 118 to selectively direct conditioned air in a desired direction. As shown in FIG. 1, grill panel 121 is coupled to output portion 118 such that air outlet is oriented upward to enable airflow in an upward direction, and cover panel 122 is coupled to output portion 118 to block airflow from exiting output portion 118 in the forward direction, away from input portion 102. It is contemplated that, in another embodiment, grill panel 121 and cover panel 122 can be switched to block airflow in the upward direction and to enable airflow in the forward direction. Additionally, in yet another embodiment, two grill panels 121 are coupled to output portion 118 to enable airflow in both the upward and forward directions. The positioning of grill panel 121 and cover panel 122 are based on the desired direction of airflow within the temporary structure.

Figure 4:
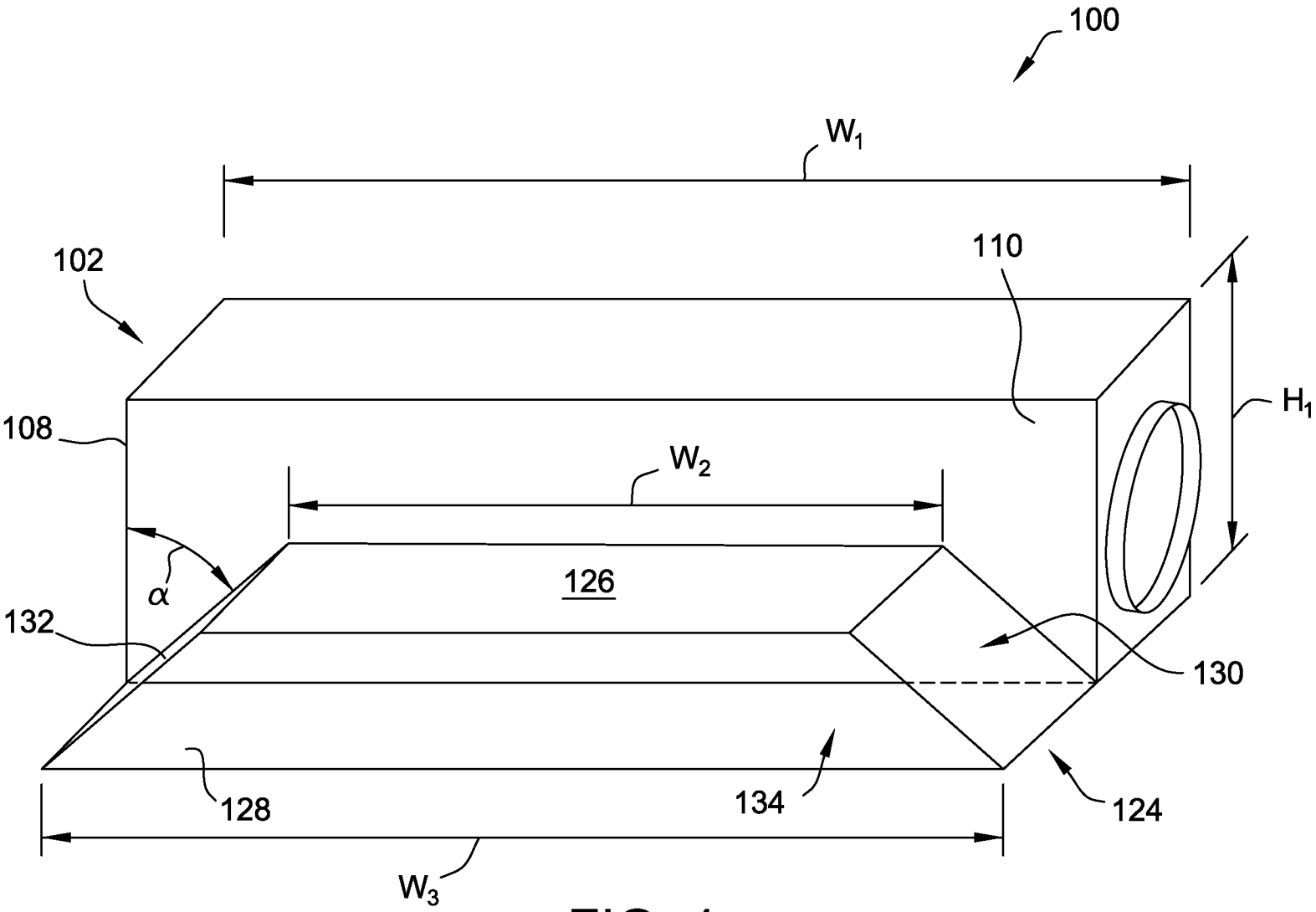
FIG. 4 depicts a front view of the air handling unit with the output portion removed.

In the exemplary embodiment, air handling unit 100 also includes a housing or a routing portion 124 coupled between input portion 102 and output portion 118. FIG. 4 further depicts air handling unit 100 with output portion 118 removed to more clearly illustrate routing portion 124. In the exemplary embodiment, routing portion 124 includes a top surface 126 having a second width W2 and a base surface 128 having a third width W3 greater than second width W2. Routing portion 124 also includes a contouring structure 130 comprising opposing angled side surfaces 132. In the exemplary embodiment, angles side surfaces 132 extend between top surface 126 and base surface 128 at an angle α with respect to endwall 108.

Figure 3:
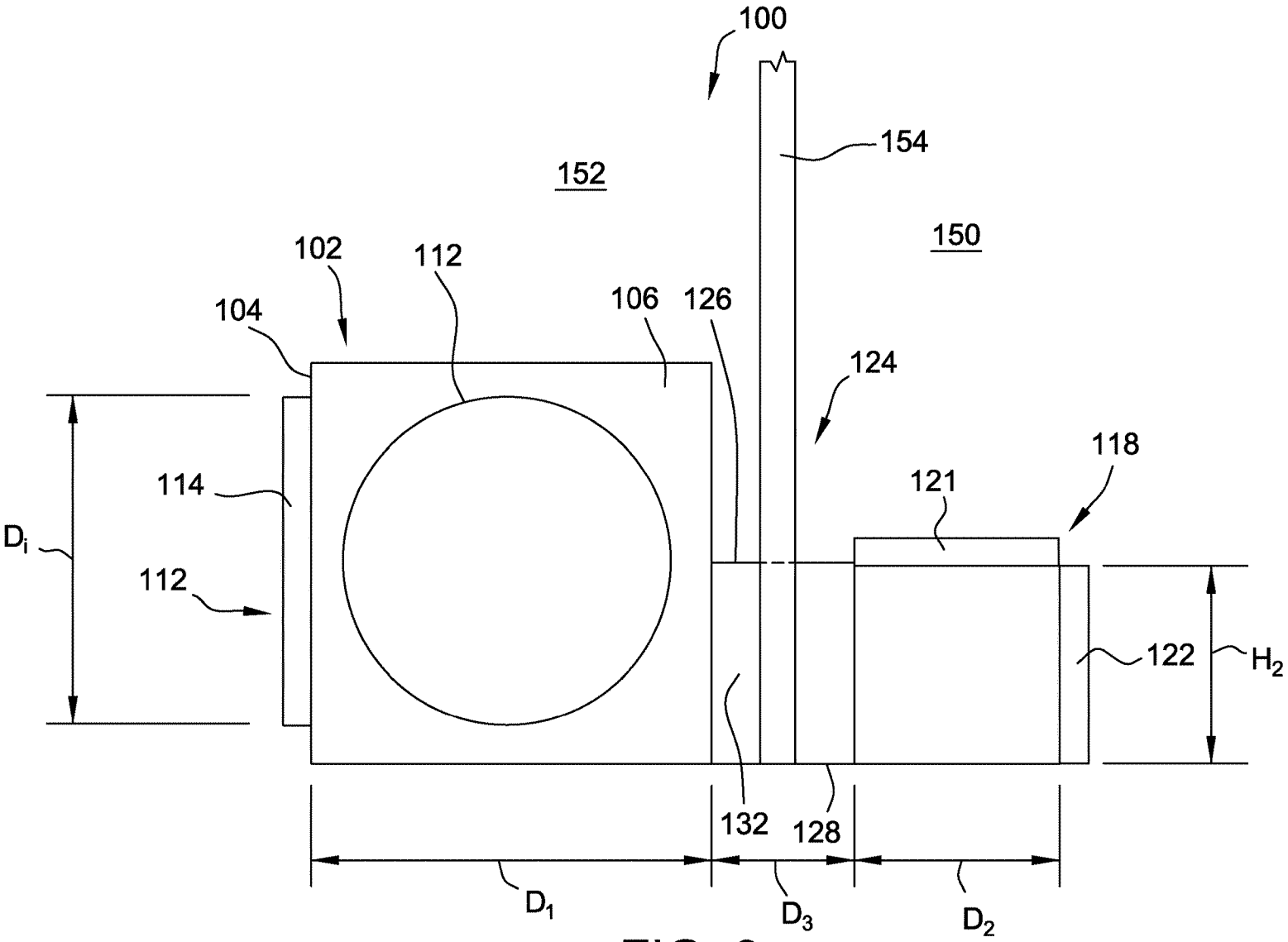
FIG. 3 depicts a side view of the air handling unit shown in FIG. 1 illustrating an air input portion and an air output portion.

As depicted in FIG. 4, routing portion 124 can take the form of a trapezoidal prism and defines an opening 134 through which the airflow is channeled from input portion 102 to output portion 118. As shown in FIG. 3, routing portion 124 extends a depth D3 of approximately 8 inches between input portion 102 and output portion 118. When utilizing air handling unit 100 to direct conditioned air to an interior space, output portion 118 can be located in the interior space 150 while input portion 102 is located outside of the interior space 150 in an external environment 152. The interior space 150 and exterior environment 152 are defined by the temporary structure 154. In the case of utilizing air handling unit 100 to channel air into a tent, routing portion 124 can be disposed at a location where the tent wall 154 falls. For example, the tent wall 154 can follow the shape of sidewalls 132 of contouring structure 130. In the exemplary embodiment, angle α of sidewalls 132 is between approximately 30 degrees and approximately 60 degrees. More specifically, in one embodiment, angle α of sidewalls 132 is approximately 45 degrees. Contouring structure 130 takes is shaped to enable the tent wall 154 to fall in an aesthetically pleasing manner. In some embodiments, contouring structure 130 can allow the tent walls to form a seal with the interior portion of the tent.

Figure 5:
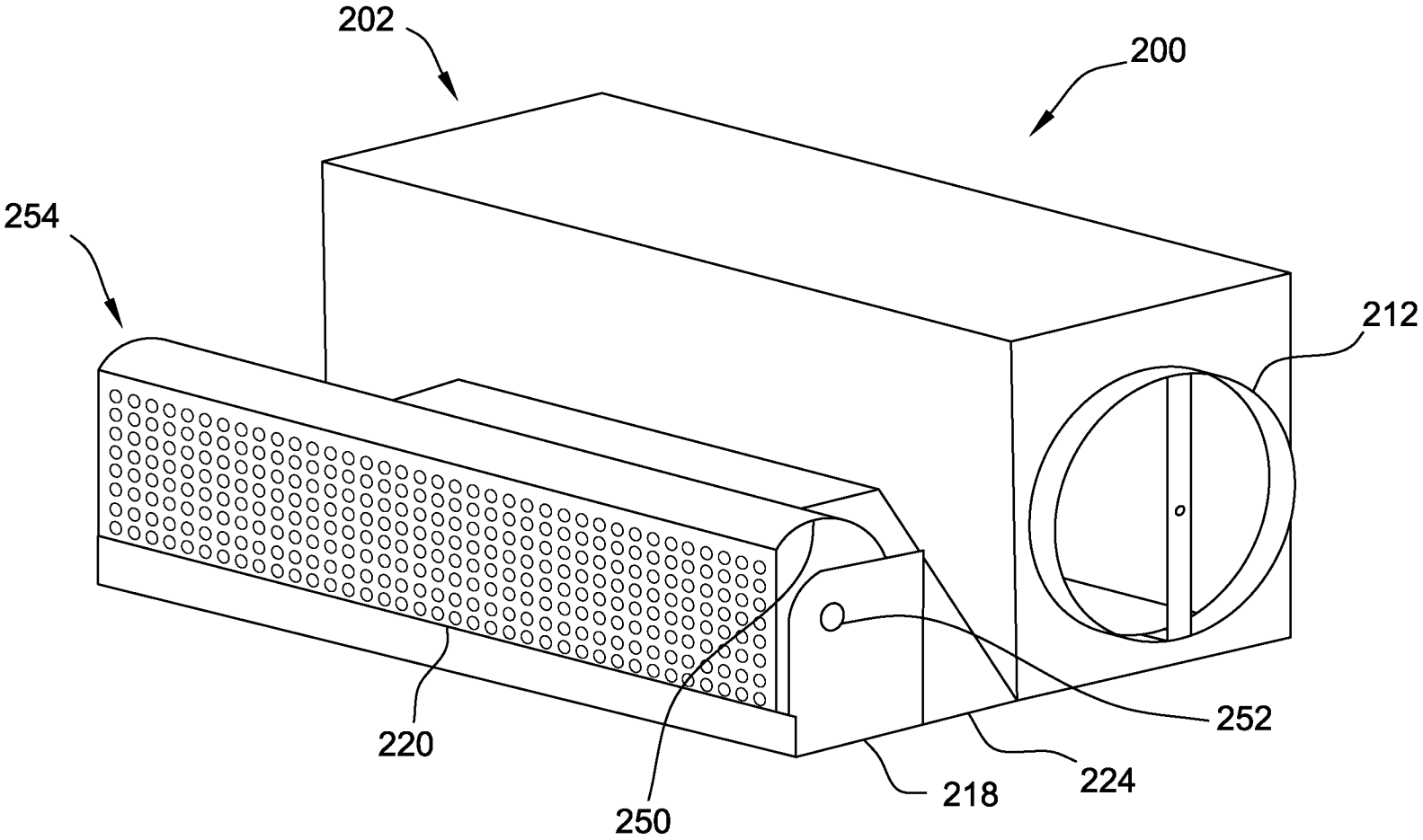
FIG. 5 depicts a perspective view of an alternative an air handling unit suitable for use with a temporary structure HVAC system including a pivotable drum mechanism.

FIG. 5 depicts a perspective view of air handling unit 200. Air handling unit 200 includes air input portion 202, air output portion 218 and routing portion 224. Air input portion 202 can define inlets 212. Routing portion 224 connects air input portion 202 to air output portion 218. Air output portion 218 includes mechanism 250. Mechanism 250 is pivotable and in operation can direct conditioned air in a substantially horizontal direction, a substantially vertical direction, or at any selected angle in between vertical and horizontal. In some embodiments, mechanism 250 can take the form of a pivot such as pivot 252. Drum 254 is coupled with pivot 252. Drum 254 includes air outlet 220 and in some embodiments can includes multiple air outlets. Air outlet 220 can include grating.

Figure 6:
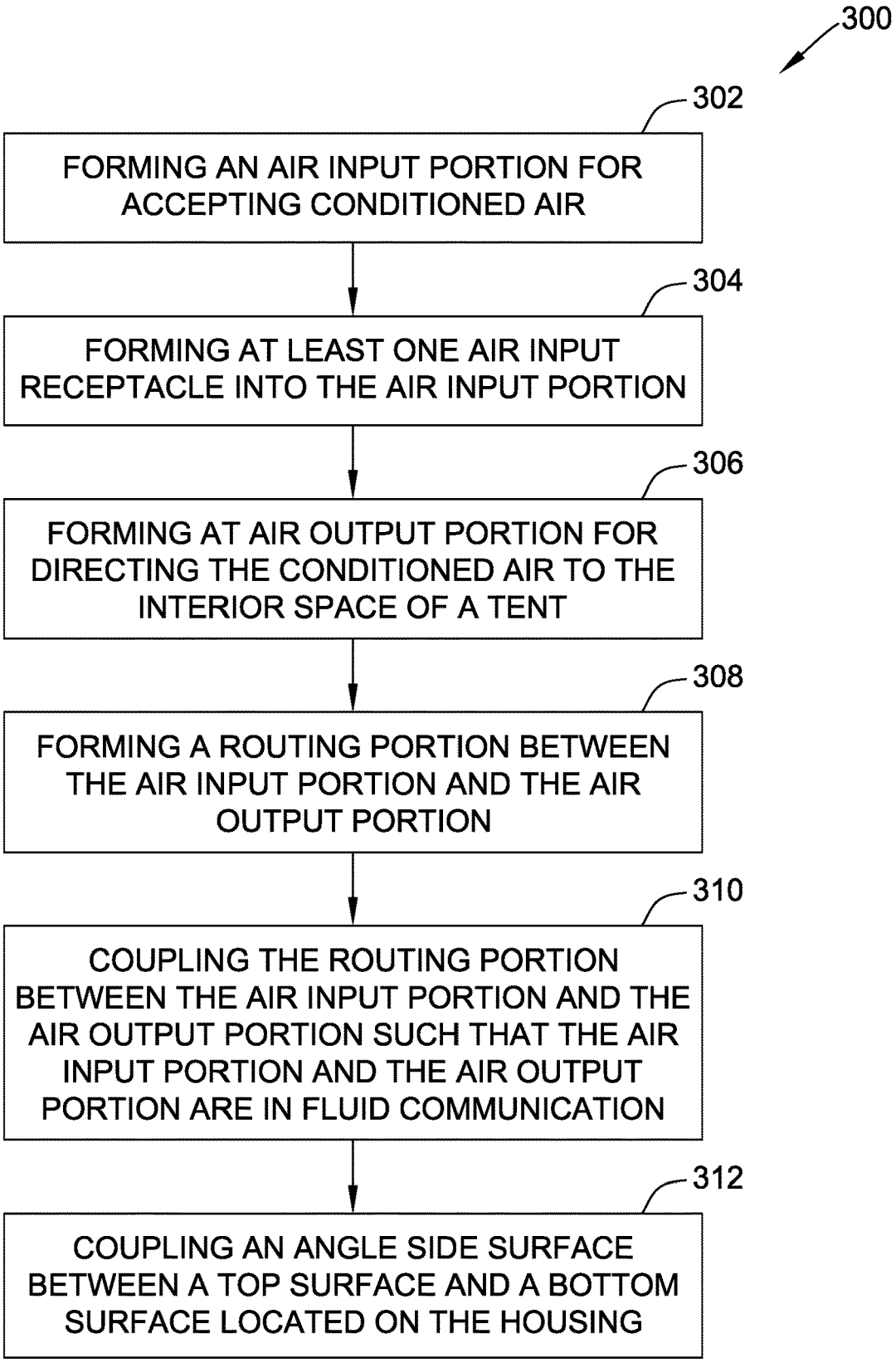
FIG. 6 depicts a flow diagram of a method of manufacturing an air handling unit.

FIG. 6 depicts a flow diagram of a method of manufacturing an air handling unit. As shown, manufacturing an air handling unit such as air handling units 100 or 200 can be accomplished with method 300. First, as in step 302, an air input portion for accepting conditioned air is formed. Second, as in step 304 at least one air input receptacle into the air input portion is formed. Third, as in step 306 an air output portion for directing the conditioned air to the interior space of a tent is formed. Fourth as in step 308 a routing portion connecting the air input portion and the air output portion is formed. Fifth, as in step 310 the routing portion between the air input portion and the air output portion can be coupled such that the air input portion and the air output portion are in fluid communication. Finally, as in step 312, an angled side surface can be coupled between a top surface and a bottom surface located on the housing, wherein the angled side surface is obliquely oriented between the top surface and the bottom surface.

Exemplary embodiments of an air handling unit for use with a heating, ventilating, and air conditioning (HVAC) system are described herein. The air handling unit includes an air input portion configured to receive conditioned air. The air handling unit also includes an air output portion configured to direct the conditioned air to an interior space of a structure. The air handling unit further includes a routing portion configured to couple the air input portion to the air output portion in fluid communication. The routing portion also includes a contouring structure configured to interface with the structure. The contouring structure includes obliquely oriented walls that interface with the temporary structure to form a seal between the interior space of the temporary structure and the exterior environment. Additionally, the air output portion includes one or a plurality of selectively coverable vents or a pivotable drum that enables a user to direct the airflow into the temporary structure in a desired direction.

Exemplary embodiments of an air handling unit and methods for assembling the same are described above in detail. The methods and assemblies are not limited to the specific embodiments described herein, but rather, components of assemblies and/or steps of the methods may be utilized independently and separately from other components and/or steps described herein. For example, the methods may also be used in combination with other HVAC systems, and are not limited to practice with only the temporary structure HVAC system as described herein. Rather, the exemplary embodiment can be implemented and utilized in connection with many other air handling applications.

Although specific features of various embodiments of the invention may be shown in some drawings and not in others, this is for convenience only. In accordance with the principles of the invention, any feature of a drawing may be referenced and/or claimed in combination with any feature of any other drawing. Further, although words such as "top" and "bottom" are used throughout the specification, there is no absolute orientation in the universe.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An air handling unit for use with a heating, ventilating, and air conditioning (HVAC) system, the air handling unit comprising:

an air input portion configured to receive conditioned air, wherein the air input portion further comprises:

a first sidewall comprising a first air inlet, a first endwall comprising a second air inlet, the first endwall oriented substantially orthogonal to the first side, and a second endwall comprising a third air inlet, the second endwall substantially orthogonal to the first side wall and substantially parallel to first endwall, wherein the first sidewall, the first endwall, and the second endwall define a rectangular prism shape;

an air output portion configured to direct the conditioned air to an interior space of a structure; and a routing portion configured to couple the air input portion to the air output portion in fluid communication, wherein the routing portion further comprises a contouring structure configured to interface with the structure.

2. The air handling unit of claim 1 wherein the routing portion comprises a base surface and a top surface smaller than the base surface and the contouring structure further comprises at least one angled side surface extending between the base surface and the top surface.

3. The air handling unit of claim 1 wherein the contouring structure creates at least a partial seal between the interior space and an environment exterior to the structure.

4. The air handling unit of claim 1, wherein one or more of the first sidewall, the first endwall, and the second endwall comprise a flange extending about a circumference of air inlets, the flange configured to connect an HVAC system to the air handling unit.

5. The air handling unit of claim 4, wherein at least one of the first sidewall, the first endwall, and the second endwall comprise a cover configured to be coupled over the air inlets to selectively block air.

6. The air handling unit of claim 4, wherein the flange of the one or more of the first sidewall, the first endwall, and the second endwall comprises a diameter of approximately 20 inches and a protrusion of approximately 2 inches around the circumference of said flange.

7. The air handling unit of claim 1 wherein the air output portion comprises at least one outlet configured to direct the conditioned air at a selected direction into the interior space.

8. The air handling unit of claim 7 wherein the outlet further comprises:

a mechanism, and a drum coupled to the mechanism and defining a vent wherein the drum is selectively pivotable to the selected direction.

9. The air handling unit of claim 8 wherein the outlet further comprises a vent comprising grating mounted to the drum.

10. The air handling unit of claim 1 wherein the output portion comprises:

a grill panel selectively positioned proximate a first opening in the output portion, wherein the grill panel defines an air outlet to enable airflow through the first opening in a first direction; and a cover panel selectively positioned proximate a second opening in the output portion, wherein the cover panel restricts airflow through the second opening in a second direction.

11. The air handling unit of claim 10, wherein grill panel is selectively positioned proximate the second opening to enable airflow through the second opening in the second direction, and wherein the cover plate is positioned proximate the first opening to restrict airflow through the first opening in the first direction.

12. A temporary structure heating, ventilating, and air conditioning (HVAC) system comprising:

a temporary structure defining an interior space and an exterior environment;

an HVAC unit positioned in the exterior environment and configured to channel conditioned air into an air handling unit, the air handling unit comprising:

an air input portion positioned in the exterior environment, the air input portion comprising at least one air inlet in fluid communication with the HVAC system, wherein the air input portion further comprises:

a first sidewall comprising a first air inlet, a first endwall comprising a second air inlet, the first endwall oriented substantially orthogonal to the first side, and a second endwall comprising a third air inlet, the second endwall substantially orthogonal to the first side wall and substantially parallel to first endwall, wherein the first sidewall, the first endwall, and the second endwall define a rectangular prism shape, an air output portion positioned in the interior space for redirecting conditioned air, and a housing connecting the air input portion to the air output portion, the housing comprising a contouring structure configured to interface with the temporary structure.

13. The air handling unit of claim 12 wherein the housing comprises a base surface and a top surface smaller than the base thereby creating the contouring structure, the contouring structure further comprising at least one angled side surface extending between the base surface and the top surface.

14. The air handling unit of claim 13 wherein the contouring structure creates at least a partial seal between the interior space and the exterior environment.

15. The air handling unit of claim 14 wherein the angle between the at least one angled side surface and the bottom surface is between 30 degrees and 60 degrees.

16. An air handling unit for use with a heating, ventilating, and air conditioning (HVAC) system, the air handling unit comprising:

an air input portion configured to receive conditioned air;

an air output portion configured to direct the conditioned air to an interior space of a structure, wherein the air output portion comprises at least one outlet configured to direct the conditioned air at a selected direction into the interior space, wherein the outlet further comprises:

a mechanism, and a drum coupled to the mechanism and defining a vent wherein the drum is selectively pivotable to the selected direction; and a routing portion configured to couple the air input portion to the air output portion in fluid communication, wherein the routing portion further comprises a contouring structure configured to interface with the structure.

17. An air handling unit for use with a heating, ventilating, and air conditioning (HVAC) system, the air handling unit comprising:

an air input portion configured to receive conditioned air;

an air output portion configured to direct the conditioned air to an interior space of a structure, wherein the output portion comprises:

a grill panel selectively positioned proximate a first opening in the output portion, wherein the grill panel defines an air outlet to enable airflow through the first opening in a first direction; and a cover panel selectively positioned proximate a second opening in the output portion, wherein the cover panel restricts airflow through the second opening in a second direction; and a routing portion configured to couple the air input portion to the air output portion in fluid communication, wherein the routing portion further comprises a contouring structure configured to interface with the structure.

18. A method of making an air handling unit for a tent heating, ventilating, and air conditioning (HVAC) system, the method comprising:

forming an air input portion for accepting conditioned air;

forming at least one air input receptacle into the air input portion;

forming a first air inlet in a first sidewall of the air inlet portion, forming a second air inlet in a first endwall of the air inlet portion, wherein the first endwall is oriented substantially orthogonal to the first sidewall, forming a third air inlet in a second endwall of the air inlet portion, wherein the second endwall is substantially orthogonal to the first sidewall and substantially parallel to first endwall, wherein the first sidewall, the first endwall, and the second endwall define a rectangular prism shape;

forming an air output portion for directing the conditioned air to the interior space of a tent;

forming a routing portion connecting the air input portion and the air output portion;

coupling the routing portion between the air input portion and the air output portion such that the air input portion and the air output portion are in fluid communication; and coupling an angled side surface between a top surface and a bottom surface located on the air input portion, wherein the angled side surface is obliquely oriented between the top surface and the bottom surface.

19. The method of claim 18 wherein the top surface comprises and an area smaller than an area of the bottom surface.

20. The method of claim 18 wherein the angled side surface creates at least a partial seal between the interior space and an exterior space of the tent.

* * * * *